US005634819A

United States Patent [19]

Pan et al.

[11] Patent Number: 5,634,819

[45] Date of Patent: Jun. 3, 1997

[54] ELECTRICAL CONNECTOR

[75] Inventors: Hua-Tsung Pan, Taipei; Ming-Yow Hon, Yung-Ho, both of Taiwan

[73] Assignee: Hon Hai Precision Ind. Co., Ltd., Taiwan

[21] Appl. No.: 585,894

[22] Filed: Jan. 16, 1996

[51] Int. Cl.[6] ..... H01R 23/70

[52] U.S. Cl. ..... 439/637; 439/947

[58] Field of Search ..... 439/60, 108, 260, 439/267, 630, 636, 637, 660, 751, 873, 885, 924.1, 924.2, 947

[56] References Cited

U.S. PATENT DOCUMENTS

Re. 266,692 9/1969 Ruehlemann ..... 439/637

3,766,513 10/1973 Carre ..... 439/924.1

3,944,313 3/1976 McKeown et al. ..... 439/260

5,051,099 9/1991 Pickles et al. ..... 439/108

*Primary Examiner*—David L. Pirlot

*Assistant Examiner*—Tho Dac Ta

[57] ABSTRACT

A card edge connector (10) includes an insulative housing (12) having a plurality of passageways (14) therein for receiving a corresponding number of signal contacts (16) therein, respectively. A plurality of grounding members (18) having only one half count to the signal contacts (16) wherein each grounding member (18) is arranged corresponding to the adjacent pair of signal contacts (16) and is configured to be received within the housing (12) in a parallel direction with regard to the inserted daughter board for engagement with the corresponding side by side adjacent pair of grounding circuit pads on the same side of the daughter board.

15 Claims, 6 Drawing Sheets

ELECTRICAL CONNECTOR

BACKGROUND OF THE INVENTION

1. Field of the Invention

The invention relates to electrical connectors, and particularly to an arrangement of the high speed or high density connector.

2. The Prior Art

Because of increasing requirements in the computer field, the high speed (frequency) and/or high density connectors are more and more desired. Unfortunately, such modern connectors also result in more interference and cross-talk among the adjacent contacts in the connector. Thus, to eliminate such disadvantages, grounding circuits or contacts are designedly arranged to be disposed beside the traditional signal contacts. And the relationship between the grounding contacts and the signal contacts is generally set in a one-by-one manner.

U.S. Pat. No. 5,026,292 discloses a high-speed card edge connector which uses a ground member positioned between each opposite pair of signal contacts for implementation of the aforementioned issue but also includes some disadvantages. First, because each ground member must includes a pair of opposite beams to contact opposite grounding pads on the inserted daughter board, and a grounding leg to contact the grounding hole in the mother board on which the connector is mounted, such ground member should be designedly arranged to be directly formed in a stamped manner from a blank for consideration of implementation of such ground member's configuration. And as well known, the stamped type member lacks sufficient resiliency for good contacting relationship with the engaged daughter board, and may tend to form burs on its edges which may jeopardize the corresponding engaged circuit pads on the daughter board, and also preclude the correct relative position of the inserted daughter board with regard to the contacts and result in inferior engagement between the daughter board and the contacts of the connector.

Secondly, each of ground members is received within the housing of the connector laterally with regard to the lengthwise direction of the housing of the connector and that is not incompliance with the direction of the carrier of the ground member during manufacturing. This incompliance results in incompatible pitch arrangement between the ground members joined with the raw carrier and the passageways in the housing, and therefore, it is required to assemble such ground member one-by-one into the connector housing, thus increasing significant assembling time and also requiring to spend much money in re-adjust the existing assembling machine.

Therefore, an object of the invention is to provide a high-speed card edge connector which includes a plurality of grounding members for compliance with the corresponding grounding circuit pads on the daughter board adapted to be inserted within the connector, and the corresponding grounding holes in the mother board on which the connector is mounted, wherein such grounding members can not only be assembled to the housing of the connector at the same time, but also achieve the superior contact engagement with the corresponding inserted daughter board.

SUMMARY OF THE INVENTION

According to an aspect of the invention, a card edge connector includes an insulative housing having a plurality of passageways therein for receiving a corresponding number of signal contacts therein, respectively. A plurality of grounding members having only one half count to the signal contacts wherein each grounding member is arranged corresponding to the adjacent pair of signal contacts and is configured to be received within the housing in a parallel direction with regard to the inserted daughter board for engagement with the corresponding side by side adjacent pair of grounding circuit pads on the same side of the daughter board.

DETAILED DESCRIPTION OF THE PREFERRED EMBODIMENT

Figure 1:
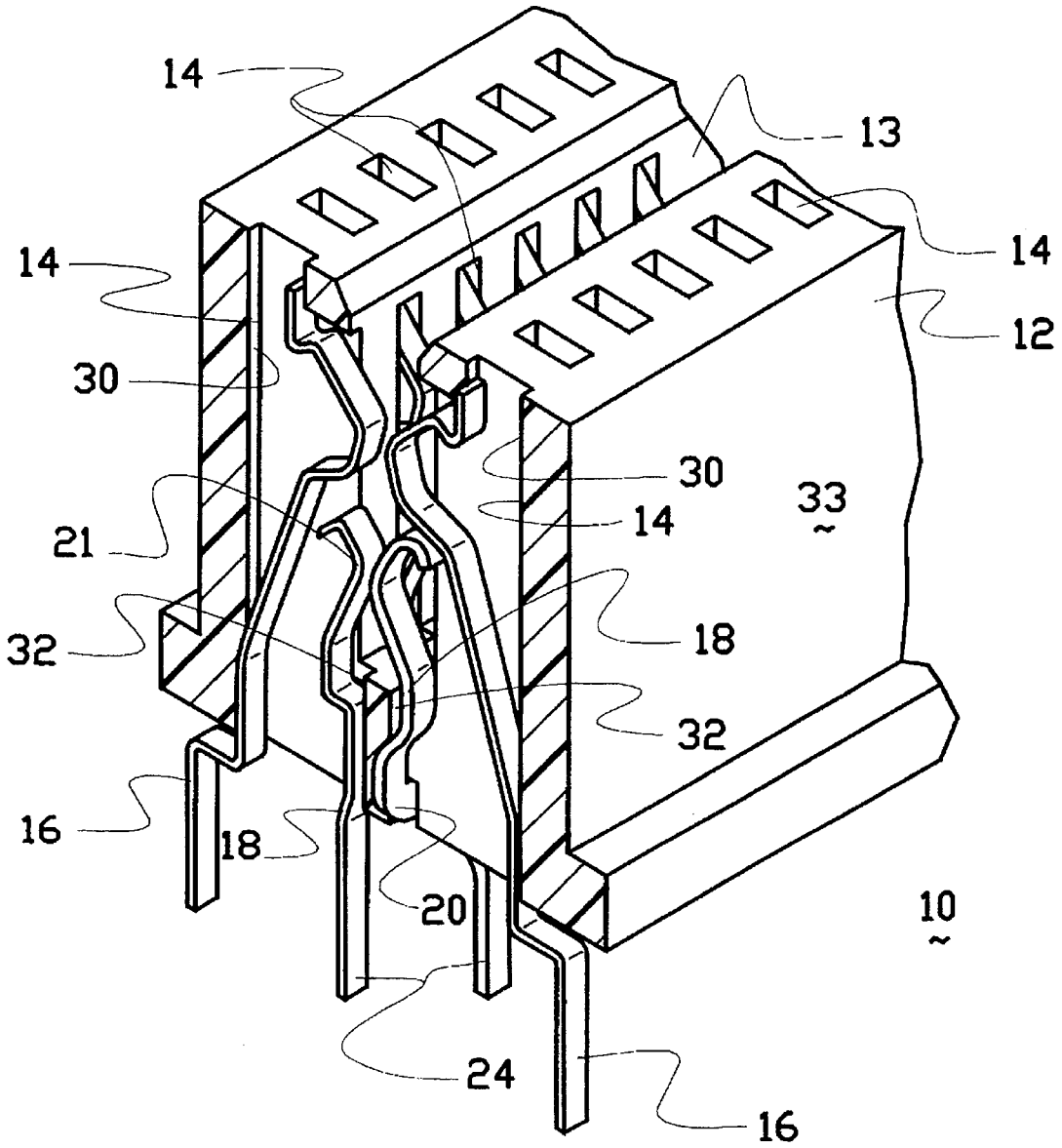
FIG. 1 is a fragmentary perspective view of the highspeed card edge connector according to the invention.

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Also, the basic structure of a card edge connector and the application thereof can be referred to the aforementioned U.S. Pat. No. 5,026,292 for quickly understanding the subject matter the invention is involved in. Attention is directed to FIGS. 1, 2, 2(A) and 3 wherein a card edge connector 10 includes an insulative housing 12 defining a central slot 13 for receiving a daughter board (not shown) therein. Two rows of the passageways 14 are respectively communicatively positioned by two sides of the slot 13 for receiving the corresponding signal contacts 16 therein, respectively.

A plurality of grounding members 18 are also disposed within the passageways 14 of the connector 10 wherein each grounding member 18 comprises a base section 20 having a pair of beams 22 extending curvedly and upward at two opposite ends thereof in the same manner, and further having a grounding leg 24 downward extending at only one end thereof.

Figure 2:
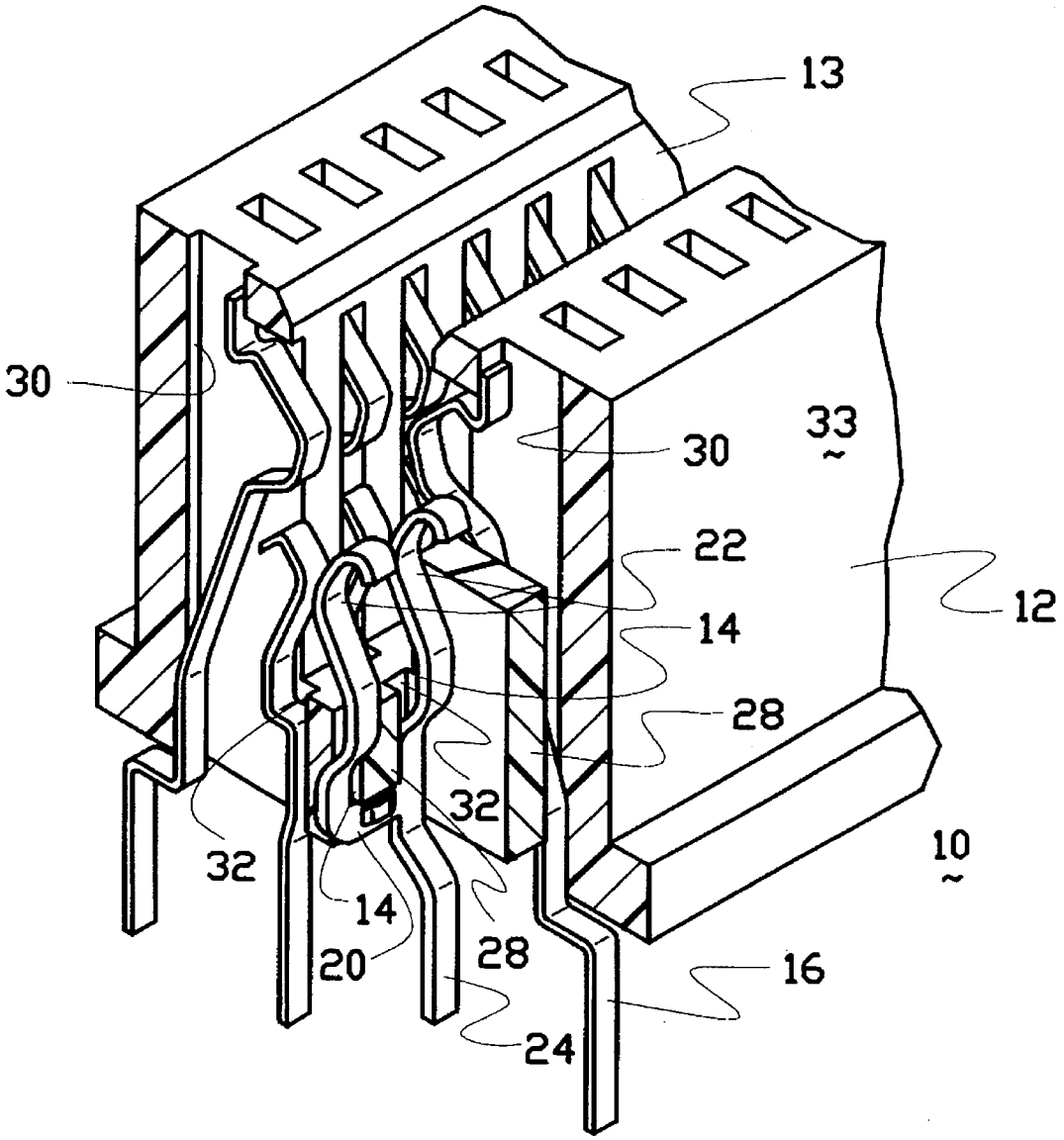
FIG. 2 is a fragmentary perspective view of the connector of FIG. 1 wherein a portion thereof has been removed to show how the grounding member is retainably received within the passageways in the connector housing.
Figure 2A:
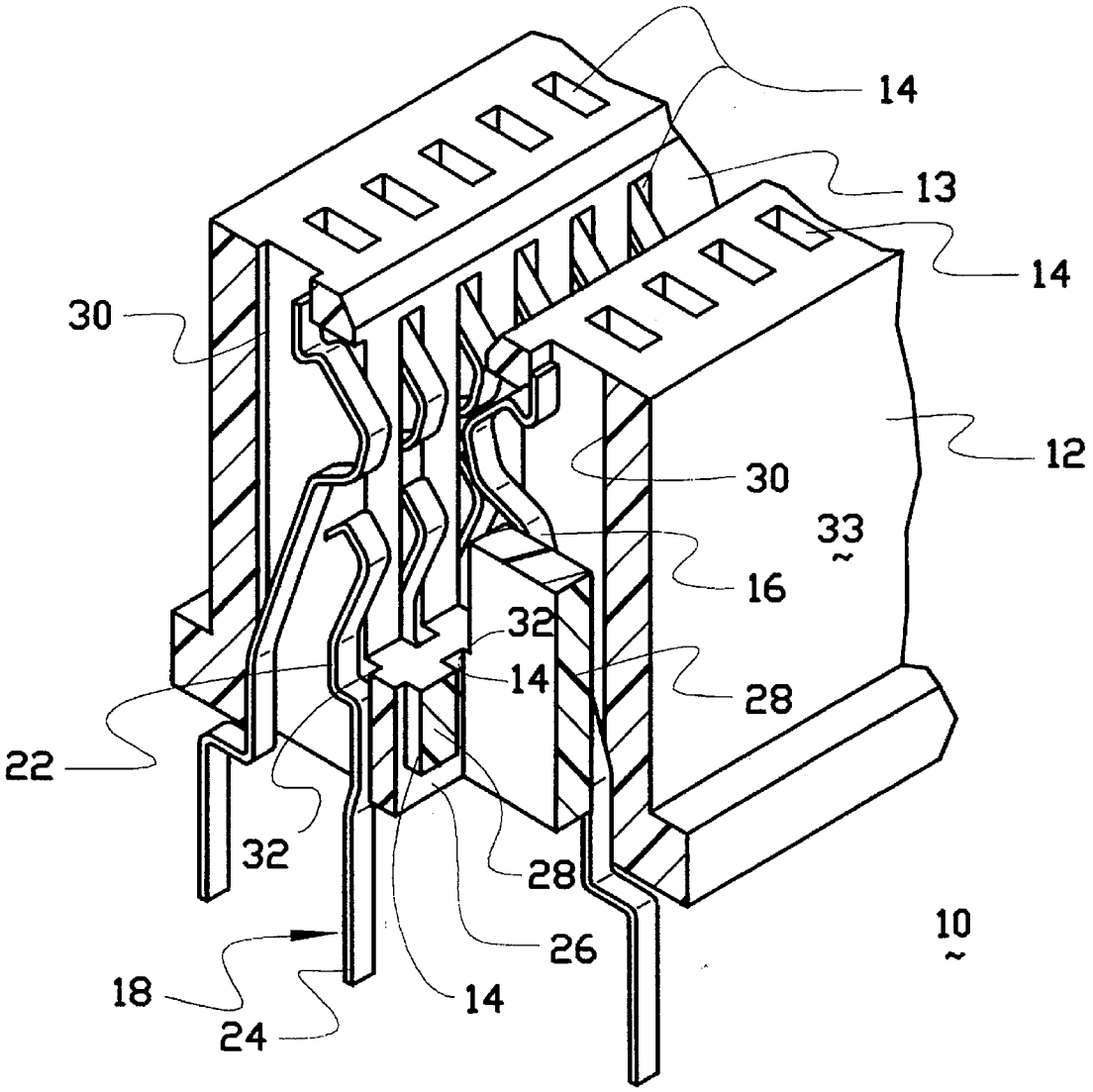
FIG. 2(A) is a fragmentary perspective view of the connector of FIG. 1 wherein a portion thereof has been removed to show a communication slit is disposed between two adjacent passageways for receiving the base section of the corresponding grounding member which substantially occupies both such two passageways.

Each grounding member 18 is designedly to be received within a pair of adjacent passageways 14 under the condition that such pair of beams 22 are respectively embedded within these two adjacent passageways 14 and the grounding leg 24 extending downward in alignment with and under only one passageway 24. As shown in FIG. 2(A), to fully enclose the base section 20 of the grounding member 18 in the housing 12 of the connector, a slit 26, which is substantially parallel to the daughter board receiving slot 13, is formed in the underside of the partition wall 28 between these adjacent two passageways 14 so that the base section 20 is snugly received within such slit 26 when the grounding member 18 is secured in the housing 12 in position. In this embodiment, each grounding member 18 has embodiment 17 projecting on the base section 20 for interferentially engagement within the corresponding slit 26 between the adjacent two passageways 14 for retaining the grounding member 18 in the corresponding passageway 14. It can be seen that the signal contacts 16 are respectively received in the corresponding passageways 14 in a one-to-one relation, while the grounding members 18 have a two-to-one relationship with the corresponding passageways 14 even though each of them have two beams 20 respectively received within the corresponding two passageways 14 in a one-to-one manner. Further more, the signal contact 16 extends along a first inner surface 30 in the passageway 14, which is closer to the central slot 13 in the housing 12, and terminates at the upper level for engagement with the upper row circuit pads on the daughter board. In contrast, the beam 22 of the grounding member 18 extends along a second inner surface 32 in the passageways 14, which is closer to side wall surface 33 of the housing 12, and terminates at the lower level for engagement with the lower row circuit pads on the daughter board.

Figure 3:
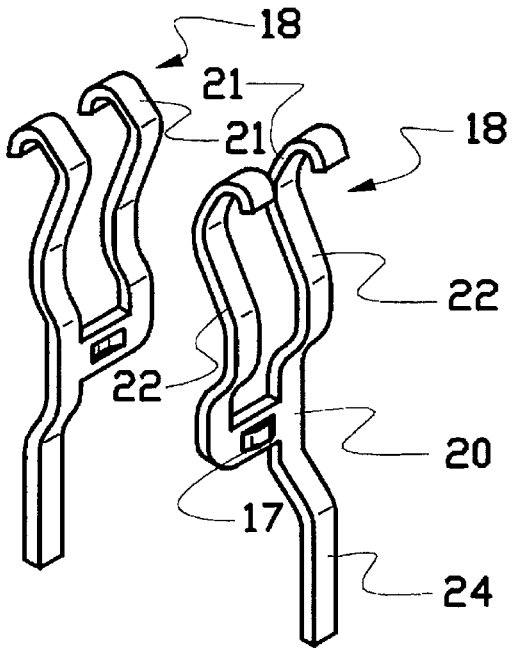
FIG. 3 is a pair of grounding members opposite to each other which are adapted to be in the connector of FIG. 1 and respectively positioned on two opposite sides of the connector.

Referring to FIG. 3, to comply with the grounding holes in a staggered state in the mother board (not shown), each adjacent pair of grounding members 18 opposite to each other are designed to have their respective grounding legs 24 extending at two diagonal ends, i.e., these two grounding legs 24 being not in the same plane orthographic to the slot 13 of the connector 10. In this embodiment, to reduce the insertion force of the inserted daughter board, the contacting apexes 21 of the beams 22 of the grounding members 18 by one side of the slot 13 are arranged to be offset from those by the other side of the slot 13 in the vertical direction. It can be understood that such pair of grounding members 18 can be optionally designed to be same with each other and the left side one is reversely assembled to the housing 12 with regard to the right one. Thus, only one mold is required to fabricate this grounding member 18.

Figure 4:
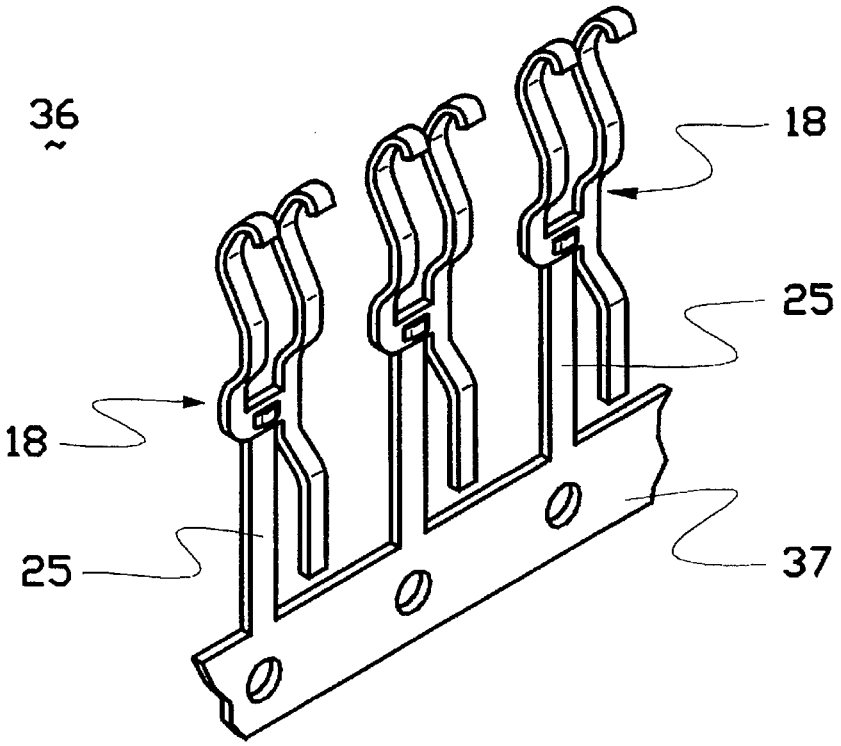
FIG. 4 is a perspective view of a carrier having plural grounding members thereon before such grounding member have been assembled into the connector housing and cut off therefrom.

FIG. 4 shows a carrier 36 having a continuos main strap 37 and a series of stamped and formed individual grounding members 18 joined therewith via connection strips 25 with the pitch in compliance with the passageways 14 in the housing 12. Because this compatible pitch arrangement and the parallel relationship between the grounding members 18 and the housing 12, such series of the grounding members 18 can be simultaneously assembled to the housing 12.

Additionally, because the grounding member 18 is designedly arranged to be in a parallel relationship with the central slot 13 and the inserted daughter board, it can be made by a forming or bending process to have the beams 22 properly curved in the direction perpendicular to the plane formed by the base section 20. Therefore, the resiliency of the curved beams 22 provide a better engagement with the inserted daughter board in comparison with the directly stamped ground member of which the two opposite beams are arranged to sandwich the inserted daughter board therebetween.

Figure 5:
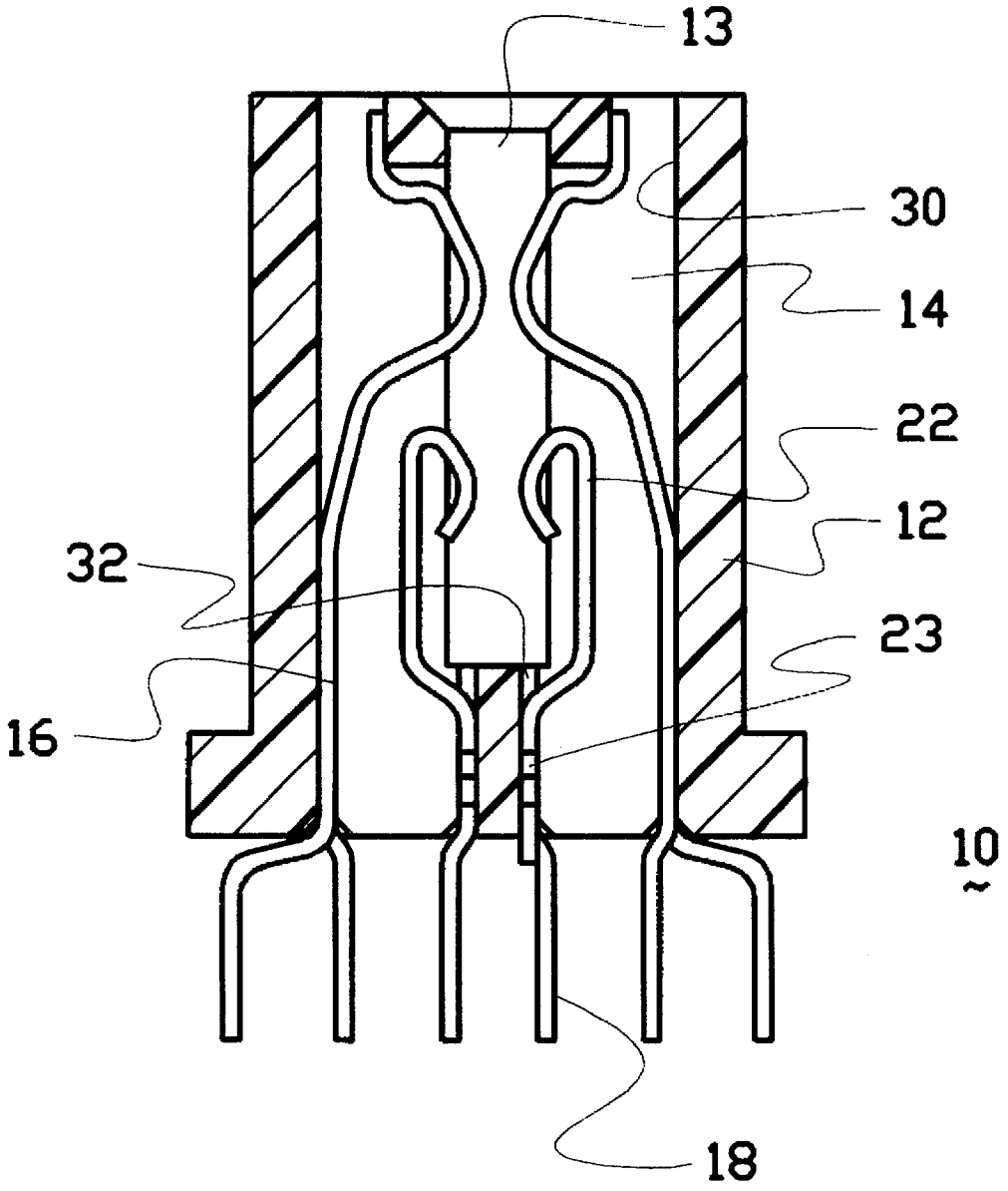
FIG. 5 is a cross-sectional view of a second embodiment of the connector according to the invention to show the grounding members are configured as a bellow type.

FIG. 5 shows another embodiment of the invention wherein the beams 22 of the grounding member 18 are of a bellow type for better resiliency and engagement. Also, the retention of the grounding member 18 is alternatively arranged to use barbs 23 on the outer edge of the beam 20.

Figure 6:
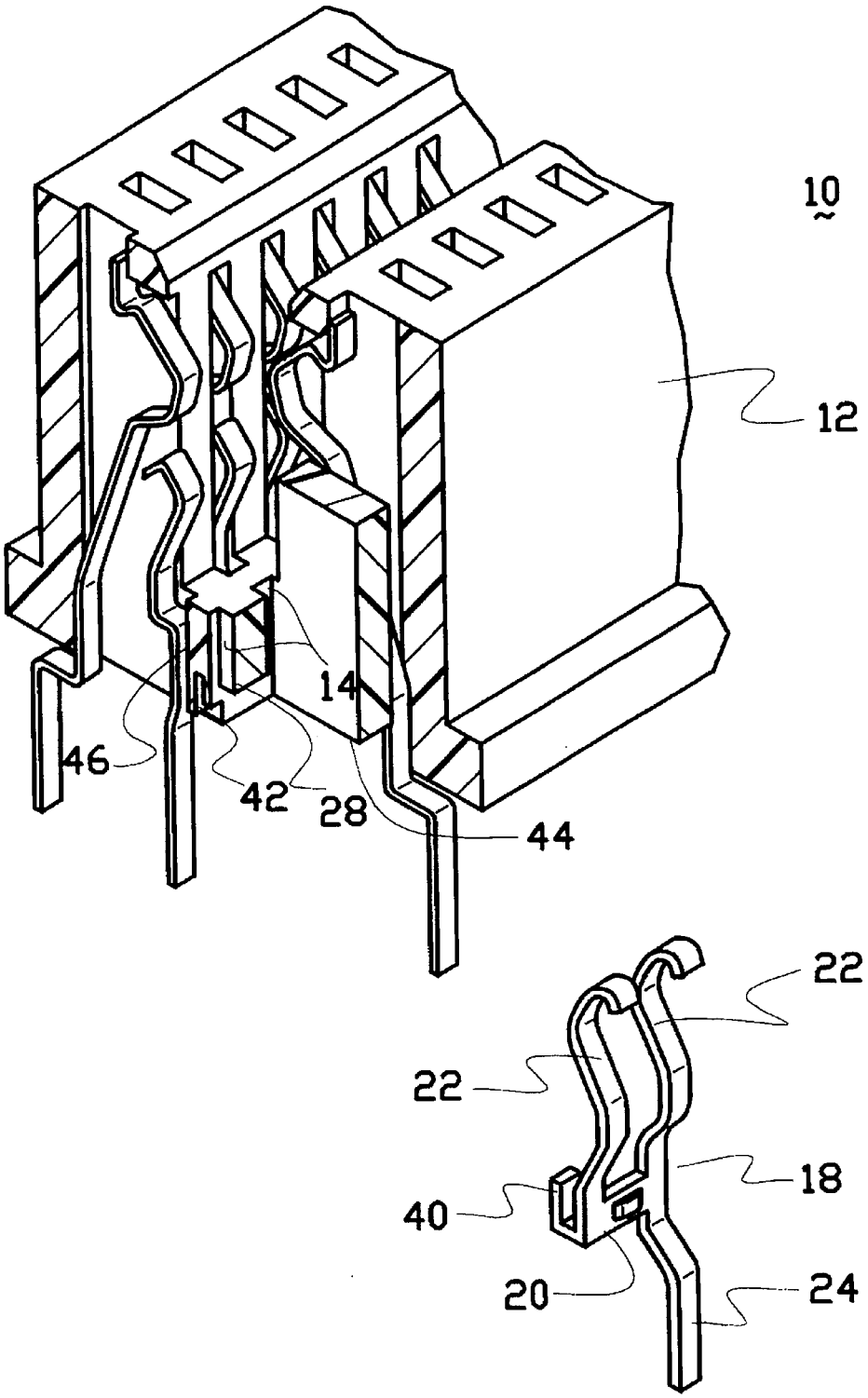
FIG. 6 is a perspective view of a third embodiment of the connector according to the invention to show the different retention means on the grounding member.

FIG. 6 shows the third embodiment of the invention, wherein said grounding member 18 further has a substitutional or additional retention tag 40 extending from the base section 20 and below a beam 22. Correspondingly, the housing 12 further includes a plurality of recesses 42 extending upward from the undersurface 44 of the central portion 46 of the housing 12, which is substantially under the slot 13. Therefore, the retention tags 40 can be interferentially respectively received within the corresponding recesses 42 of the housing 12 for retaining the grounding members 18 in position with regard to the housing 12.

While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A card edge connector for use with a daughter board, comprising:

a housing defining a central slot for receiving said daughter board;

a plurality of passageways disposed by two sides of the slot;

a corresponding number of signal contacts positioned in the corresponding passageways, respectively; said connector being characterized in that:

a plurality of grounding members have only one half count in comparison with the signal contacts and are adapted to be received within the corresponding passageways under the condition that each of said grounding members includes a base section having two beams upward extending proximate two opposite ends thereof for respective reception within a corresponding side-by-side adjacent pair of passageways shared with the two corresponding signal contacts wherein each of said grounding members are arranged in a parallel relationship with central slot in the housing.

2. The connector as defined in claim 1, wherein each beam of said grounding member are arranged to extend upward proximate a first inner surface in the passageway closer to the central slot, and the corresponding signal contact positioned in the same passageway with said beam, is arranged to extend upward proximate a second inner surface in the passageway closer to a side wall surface.

3. The connector as defined in claim 1, wherein each grounding member further includes a grounding leg extending downward from one end of the base and in alignment with the corresponding beam thereabove.

4. The connector as defined in claim 1, wherein a retention tag extends proximate one end of the base section of each of the grounding members for interferential engagement within a corresponding recess in a central portion under the central slot of the housing.

5. The connector as defined in claim 1, wherein the housing further includes a plurality of slits in parallel relationship with the central slot, and each slit extends through a partition wall between every two adjacent passageways for snugly receiving the base section of each of said grounding members therein.

6. The connector as defined in claim 5, wherein said base further includes an embodiment on the base section for interferential engagement within the corresponding slit.

7. A grounding member for use with a card edge connector which defines a central slot for receiving a daughter board therein and a plurality of passageways by two sides of the slot for receiving a corresponding number of signal contacts therein, respectively, comprising:

a base section;

a pair of beams extending upward from two opposite ends of the base section for respectively reception within two side-by-side adjacent passageways in the connector, wherein each beam is designedly curved by a forming process in a direction along a plane which is perpendicular to the base section; and a grounding leg extending downward from only one end of the base section and generally in alignment with one beam thereabove.

8. The contact as defined in claim 7, wherein an embossment is formed on the base section for interferential engagement within a slit in the housing.

9. The contact as defined in claim 7, wherein a retention tag is formed on one end of the base section opposite to the other end which has the grounding leg extending therefrom for interferential engagement within a recess in a central portion of the housing.

10. The contact as defined in claim 7, wherein retention barbs are formed on an edge of the beam.

11. A carrier for one time assembling a series of grounding members to a housing of a card edge connector, said carrier comprising:

a continuous main strap;

a series of grounding members joined therewith via a plurality of connection strips, respectively, wherein each of grounding members includes a base section having a pair of beams extending proximate two opposite ends of the base section for respectively reception within a corresponding pair of side- by-side adjacent passageways in the housing of the card edge connector;

said beams extending curvilinearly in a plane perpendicular to the base section; and a grounding leg downward extending from the base section; wherein said carrier can carry said series of grounding members with a compatible pitch arrangement with the passageways of the housing so as to have said series of grounding members simultaneously inserted into the passageways of the housing of the connector.

12. A card edge connector for use with a daughter board, comprising:

a housing defining a central slot for receiving said daughter board;

a plurality of passageways disposed by two sides of the slot;

a corresponding number of signal contacts positioned in the corresponding passageways, respectively; said connector being characterized in that:

a plurality of grounding members are adapted to be received within the corresponding passageways under the condition that each of said grounding members includes a base section having plural beams upward extending therefrom for respective reception within a corresponding number of passageways shared with the corresponding signal contacts wherein each of said grounding members are arranged in a parallel relationship with central slot in the housing.

13. The connector as defined in claim 12, wherein said grounding member further includes at least one grounding leg extending downward from the base section and in alignment with at least one of said beams thereabove in a vertical direction.

14. The connector as defined in claim 12, wherein said grounding members is positioned proximate a first inner surfaces of the passageways closer to the central slot, and said signal contacts is positioned proximate a second inner surfaces of the passageways closer to a side wall surface.

15. The connector as defined in claim 14, wherein a slit, which is parallel to the central slot, is formed between at least every two passageways adjacent said first inner surfaces for receiving the corresponding base section therein.

* * * * *